United States Patent [19]

Kastinger

[11] 4,222,184

[45] Sep. 16, 1980

[54] SKI BOOT

[76] Inventor: Hermann Kastinger, A4863 Seewalchen, Austria

[21] Appl. No.: 11,657

[22] Filed: Feb. 12, 1979

[30] Foreign Application Priority Data

Feb. 13, 1978 [DE] Fed. Rep. of Germany ..... 2805943

[51] Int. Cl.[2] ..... A43B 5/04

[52] U.S. Cl. ..... 36/121; 36/118

[58] Field of Search ..... 36/118, 119, 120, 121

[56] References Cited

U.S. PATENT DOCUMENTS

| | | | |
|---|---|---|---|
| 3,713,231 | 1/1973 | Mochizuki | 36/121 |
| 3,735,508 | 5/1973 | Gertsch et al. | 36/121 |
| 4,095,356 | 6/1978 | Robran et al. | 36/121 |

FOREIGN PATENT DOCUMENTS

| | | | |
|---|---|---|---|
| 2712001 | 9/1977 | Fed. Rep. of Germany | 36/121 |

*Primary Examiner*—Patrick D. Lawson

*Attorney, Agent, or Firm*—Hill, Van Santen, Steadman, Chiara & Simpson

[57] ABSTRACT

A ski boot comprising a base shell having a bottom sole and a calf shell; hinge means joining the calf shell at its lower end to the base shell adjacent to an ankle section of the base shell thus providing a hinged point therebetween. A traction device is provided for securing the base shell with the calf shell in clamped engagement with a leg calf of a wearer and is joined at an upper end to said calf shell above the hinge point. The traction device has opposite ends which are connected to opposite sides of the base shell at shell areas opposing an instep of the foot. The traction device further includes guides means on opposite sides of the ankle section beneath the hinge means which guide means are cooperable with said traction device for applying clamping force through the calf shell to a leg calf of a wearer. The calf shell is pivoted on the hinge means rearwardly away from the leg calf through an over center position relative to the hinge means to release the clamping force to enable the wearer to remove the ski boot from the foot.

8 Claims, 2 Drawing Figures

SKI BOOT

This invention broadly relates to a ski boot. The boot has a base shell bearing a sole. A calf shell is hinged to and secured with the base shell at an upper area adjacent to its ankle section. According to important features of the invention, a new and improved traction device or cable is provided and which engages above the hinge point on the calf shell and which traction device extends along opposite sides of the ski boot and is attached at each side to an instep seat located in the base shell. The instep seat can be pressed against the instep of the foot of the wearer.

Ski boots of the general type are shown in German OS No. 2,712,001. In this known embodiment, the deflection point of the cable lies on the slueing axis of the calf shell or, respectively, on the calf shell itself. In its open position, the cable is not extended between instep seats and guides. Upon tilting the calf shell to the front, pegs located on the calf shell press onto this freely tensed part of the cable so that the ends of the cable connected with the instep seat are moved toward the back in order to press the foot into the ankle section of the base shell above the instep. This system functions faultlessly only when, upon the forward tilting of the calf shell, the pegs actually strike the cable and then securely displace these for the stretching process. This result, however, is not guaranteed when the parts of the shoe have loosened because of repeated use and, particularly, when the parts are encrusted by snow or, respectively, ice. Moreover, where the calf shell is subjected to a constantly increasing tension when moved in the closing direction via the cable, the calf shell tends to return to an open position. Therefore, in every case, the calf shell must be fixed in a locked position. This fixing, however, is rendered more difficult because of a toolback or recoil tendency, since a closing is only possible when the calf shell is held against this tension directed backwards.

Another type of ski boot that has become known (German AS No. 2,316,443) is one where an instep seat is pressed against the instep of the foot. The movement of the instep seat on this type boot occurs by means of a laterally designed tension element which is actuated via a laterally attached tension lever. This arrangement is disadvantageous since the tension lever for actuating the instep seat extends laterally beyond the base shell and presents a hindrance and further gives rise to the danger that the tension lever will be opened when the boot strikes against resistance on the tension lever side of the boot during the descent of the skier.

Another disadvantage of the above boot is that the known shin-bone shell running up to the knee must be hinged relatively high in the side wall of the base shell, although the sole area would be a more suitable place for the hinged connection. With the hindrance caused by the tension lever, a low hinging at the sole area is not possible, as compared with the unique boot herein disclosed.

With reference to this state of the art, the object of the invention is to further develop a ski boot of the initially cited species which operates free of the problems discussed above and also of a type that the shin-bone shell can be hinged at the sole area (FIG. 1) if such a construction is decided upon by the boot maker.

The ski boot of this invention comprises a base shell having a bottom sole and a calf shell. A hinge means joins the calf shell at its lower end to the base shell adjacent to an ankle section of the base shell, thus providing a hinged point therebetween, and a traction device for securing the base shell with the calf shell in clamped engagement with a leg calf of a wearer and is joined at an upper end to the calf shell above the hinge point. The traction device has opposite ends connected to opposite sides of the base shell at shell areas opposing an instep of the foot. The traction device further includes a guide means on opposite sides of the ankle section beneath the hinge means and cooperates with the traction device for applying clamping force through the calf shell to a leg calf of a wearer. The calf shell is pivoted on the hinge means rearwardly away from the leg calf through an over center position relative to the hinge means to release the clamping force to enable the wearer to remove the ski boot from the foot.

The deflection of the cable occurs below the slueing or pivotal axis on the ankle section of the base shell, and as a result, the cable is automatically displaced in the desired manner as the calf shell is moved about its hinge point. As a result of this construction, a further advantage occurs in that, in the first phase of the stretching, a relatively large path is overcome when the cable is still subject to a relatively low tension. The lever ratios and the displacement of the cable with the stretcher seat are such that, despite higher tension of the stretcher seat in the area of the closing phase of the calf shell, the cable and the force exerted on the cable decreases, whereby the manipulation is significantly facilitated. Moreover, because of the constant restraint, a problem-free functioning is guaranteed.

In order to change the initial position of the instep seat, a retaining mount can be provided with a plurality of retaining teeth arranged vertically above one another so that the point of arrest of the cable can be changed in the retaining mount.

Advantageously, the retaining mount at the same time forms the mount for the hinging of the calf shell so that one can make do with a single mount located on the calf shell.

According to other advantages, the pull element or cable can be designed having a loop-like shape passing through and engaging the retaining mount, which cable extends on both sides of the base shell via a deflection mount or guide and is connected with one respective free end to one respective side of the instep seat. At the area of the passage of the cable through the base shell in the area of the deflection, the cable is extended through an essentially immobile guidance sleeve so that the cable is not subjected to high friction upon the functioning of the parts.

So that the calf shell is not subjected to a return tension directed to the back in its closed state, the pivotal axis of the calf shell and the deflection mount are arranged with regard to one another in such a manner that during the last closing phase, the cable overcomes a dead center position so that the calf shell is pressed into the closed position by means of the cable standing under tension.

Since the cable projects beyond the base shell in the lateral area of the base shell, the point of attachment of the shin-bone shell can be moved down to the sole and can be hinged there. With this construction, the calf shell closes the rear, open area of the shin-bone shell so that the calf shell also fulfills a holding and protecting function in addition to the tension function so that it is no longer necessary to cover over the rear, open shin-bone shell by means of a legging-like material, particularly since the employment of such a legging material has been found uncomfortable on prior boot constructions.

Further details, features and advantages of the invention will become apparent from a consideration of the attached drawings described below, as follows.

Figure 1:
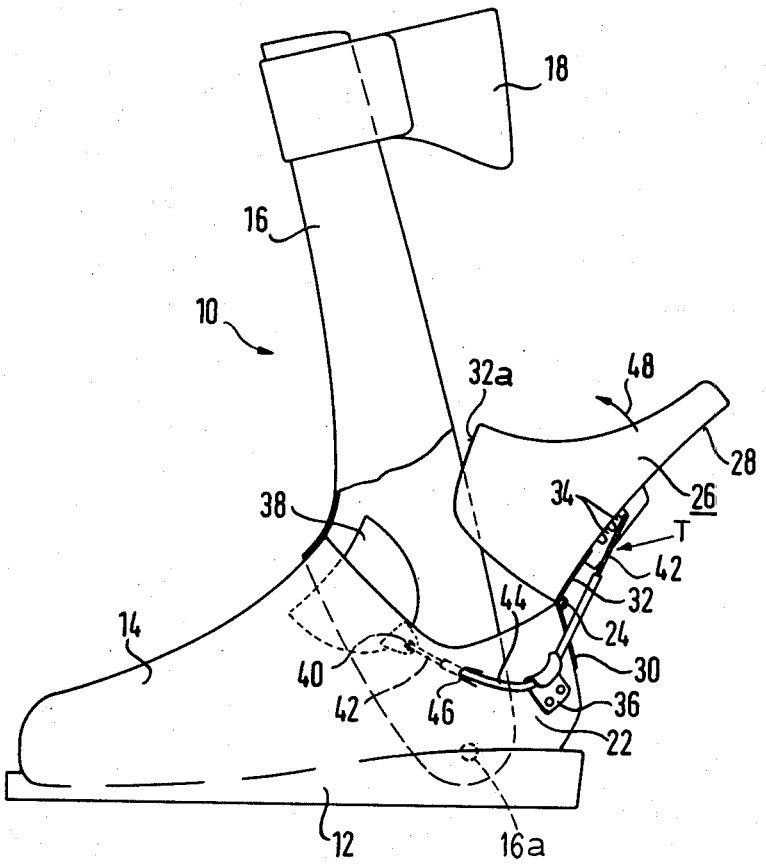
FIG. 1 is a side view of a partially hinged-open ski boot.

The ski boot 10 illustrated in the drawings essentially consists of a base shell 14 provided with a sole 12. In the back area of the sole, a shin-bone shell 16 is riveted at 16*a*, 16*a* onto both sides of the base shell 14 at the area of the sole 12. The shell 16 partially overlaps the base shell 14. The shin-bone shell 16 preferably extends upwardly to a point below the knee of the skier. There is a leg strap 18 at the upper end of the shin-bone shell 16. At the upper rear edge 20 of the ankle section 22 of the base shell 14, a calf shell 26 is hinged to the base shell 14 by means of a pin 24. The back contour 28 of the calf shell 26 forms an extension of the rear edge 30 of the ankle section 22 of the base shell 14 when the calf shell 26 is in a closed position. The lower surface 32*a* is fitted to the base shell 14.

A traction device T is provided for securing the base shell 14 and the calf shell 26 in secured relation with a leg of the wearer. The device T includes a retaining mount 32, which preferably exhibits a plurality of retaining teeth 34 arranged vertically above one another. The mount 32 is located on the rear surface 28 of the calf shell 26. Preferably, the retaining mount 32 is at the same time a component part of the joint or hinge between the calf shell 26 and the ankle section 22 of the base shell 14. One respective deflection mount or guide 36 is located to the side of the ankle section 22 below the pin or hinge axis 24. Within the base shell 14, there is located an instep seat 38 in the instep area, which instep seat 38 presses against the instep of the foot located in the ski boot when the boot is closed.

Figure 2:
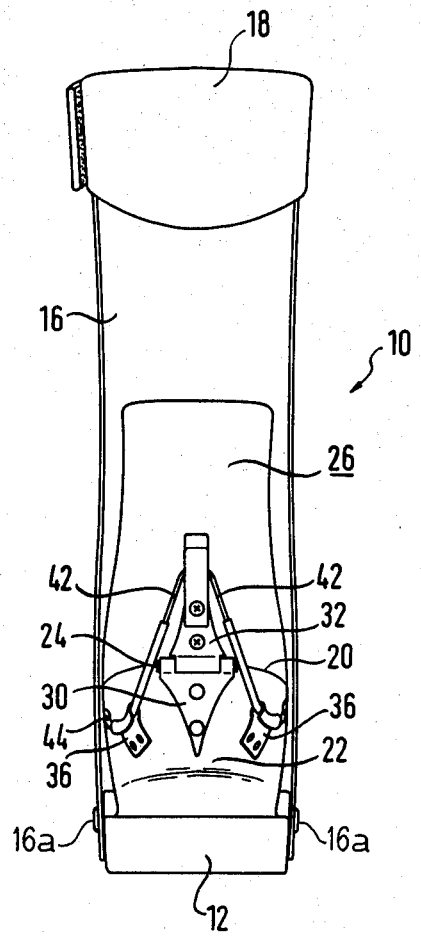
FIG. 2 is a rear view of the closed ski boot.

It can be seen especially well, particularly from FIG. 1, that the traction device has a cable or cable pull 42 with its free ends 40 being secured to the sides of the instep seats 38. The cable 42 proceeds from these fastening points through a fixed sleeve 44 located on either side of the base shell 14 around the deflection mounts or guides 36 and then is slung loop-like in one of the retaining teeth 34 of the retaining mount 32. The cable and the sleeve proceed through a hole 46 in the side of the base shell 14 from the inside to the outside. The lateral course of the cable follows particularly clearly from FIG. 1, and the rear, loop-like course of the cable through the mount 32 as well as the mount 32 itself can be clearly seen from FIG. 2.

In order to step into the ski boot, the calf shell 26 is first completely hinged open. Thereby, the instep seat 38 moves into its highest position so that the foot can be introduced into the base shell 14 without difficulty and the instep of the foot is located below the instep seat 38. When the calf shell 26 is now hinged up in the direction of the arrow 48 (FIG. 1), then the end points 40 of the cable 42 and, thus, also the instep seat 38 move to the rear so that the ankle is pushed into the ankle section 22 and is clamped. The force exerted against the ankle occurs as a result of the specific arrangement of the retaining mounts 32, 34 and the pin or axis 24 with respect to the deflection mount or guide 36. To this end, the distance between the fixed point of the cable 42 in the retaining mount 32 and the deflection mount or guide 36 is enlarged when the calf shell 26 is hinged forward in the direction of arrow 48. Shortly before the calf shell 26 is located in its closed final position, the cable 42 passes the pin or axis 24 so that in the final position of the calf shell 26, the cable holds the calf shell 26 in the closed position since an inversion of the pulling direction occurs because of the crossing of the dead center.

Finally, when the calf shell 26 is closed, the shin-bone shell 16 can be connected to the leg below the knee by means of strap 18. Thus, on the one hand, the calf shell 26 serves for support at the rear and the covering of the calf area, particularly since the shin-bone shell is open at the rear, and, on the other hand, serves as the tensing element for clamping the foot into the ankle section 22 via the instep.

The boot consists of plastic material with a composition of soft and hard material so that the soft material is in direct contact with the skin. The cable 42 consists of a flexible steel wire. The ends 40 thereof are fixed to the instep seat. The instep seat 38 itself is movably disposed in the boot shell 14 so that the foot of the user can be forced into the ankle section 22 of the base shell 14 when the calf shell 26 is moved in the direction of arrow 48. The cable is loose when the calf shell 26 is in an open position and is taut when the calf shell is in a closed position.

The shin-bone shell 16 is hinged to the sole by the pins 16*a*, 16*a* so that the shin-bone shell 16 is movingly assembled with the base shell at the sole. The forward movement of the shin-bone shell is limited by engagement of said shell with the base shell 14.

The seat between the engaged edges of the boot shell 14 with the calf shell 26 is so that the faced edges of these shells are in overlapping relationship.

I claim as my invention:

1. A ski boot comprising:

a base shell having a bottom sole and a calf shell;

hinge means joining said calf shell at its lower end to said base shell adjacent to an ankle section of the base shell thus providing a hinged point therebetween, and a traction device for securing said base shell with said calf shell in clamped engagement with a leg calf of a wearer and being joined at an upper end to said calf shell above said hinge point, said traction device having opposite ends connected to opposite sides of said base shell at shell areas opposing an instep of the foot, said traction device further including guide means on opposite sides of said ankle section beneath said hinge means and cooperable with said traction device for applying clamping force through said calf shell to a leg calf of a wearer, said calf shell being pivoted on said hinge means rearwardly away from the leg calf through an over center position relative to said hinge means to release the clamping force to enable the wearer to remove the ski boot from the foot.

2. A ski boot according to claim 1, wherein mounting means is provided for securing the traction device to the calf shell and which includes said retaining guide means, said retaining guide means being provided with a plurality of retaining teeth arranged vertically above one another, said traction device being engageable with anyone of said teeth in alternative adjusted positions for adjustably securing the calf shell relative to the leg calf of the wearer.

3. A ski boot according to claim 1, wherein the retaining device is at the same time a part of the hinge.

4. A ski boot according to claim 2, wherein the retaining device is at the same time a part of the hinge.

5. A ski boot according to claim 1, the traction device being a loop-like cable and being extended through the retaining guide means in secured assembly, said cable being cooperable with said guide means which secures the cable on both sides of the base shell, said cable being attached with each of its respective free ends being secured to one respective side of an instep seat provided on said base shell.

6. A ski boot according to claim 5, the retaining guide means, a hinge axis between said base and calf shells and the guide means are arranged in such a relationship to one another that when the calf shell is in a closed position, the part of the cable pull located between the retaining guide means and the deflection mount lies on the other side of the hinge axis after passing a dead center position.

7. A ski boot according to claim 5, wherein an essentially immobile guidance sleeve is provided in protective assembly with said cable pull, the sleeve being provided at least in the area of a passage through a side wall of the base shell and in the area of the guide means.

8. A ski boot according to claim 1, wherein a shin-bone shell is mounted on the base shell and at least partially covers the base shell and the calf shell, said shin-bone shell being hinged close to the sole in the side walls of the base shell and thereby partially covers the cable pull.

* * * * *